US011171437B2

(12) United States Patent
Arai et al.

(10) Patent No.: US 11,171,437 B2
(45) Date of Patent: Nov. 9, 2021

(54) CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Kenta Arai, Mie (JP); Yuya Fukami, Mie (JP); Daisuke Ebata, Mie (JP); Ryuta Takakura, Mie (JP); Masaki Mizushita, Mie (JP); Tetsuya Nishimura, Mie (JP); Haruka Nakano, Mie (JP); Housei Mizuno, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/960,409

(22) PCT Filed: Oct. 31, 2018

(86) PCT No.: PCT/JP2018/040495
§ 371 (c)(1),
(2) Date: Jul. 7, 2020

(87) PCT Pub. No.: WO2019/142442
PCT Pub. Date: Jul. 25, 2019

(65) Prior Publication Data

US 2020/0335898 A1 Oct. 22, 2020

(30) Foreign Application Priority Data

Jan. 22, 2018 (JP) ..... JP2018-007954

(51) Int. Cl.
*H01R 13/514* (2006.01)
*H01R 13/436* (2006.01)
(Continued)

(52) U.S. Cl.
CPC ..... *H01R 13/4361* (2013.01); *H01R 13/502* (2013.01); *H01R 13/514* (2013.01); *H01R 13/518* (2013.01); *H01R 2201/26* (2013.01)

(58) Field of Classification Search
CPC ..... H01R 2201/00; H01R 2201/26
(Continued)

(56) References Cited

U.S. PATENT DOCUMENTS 7,993,170 B2 * 8/2011 Nakata ..... H01R 13/4223 439/877
10,205,264 B2 * 2/2019 Washio ..... H01R 13/518
(Continued)

FOREIGN PATENT DOCUMENTS

CN 101859930 10/2010
JP 2001-102122 4/2001
(Continued)

OTHER PUBLICATIONS

Official Action in Chinese Application No. 201880087226.6 dated Mar. 2, 2021, along with English-language translation thereof.
International Search Report issued in International Patent Application No. PCT/JP2018/040495 dated Feb. 5, 2019, along with English translation thereof.
(Continued)

*Primary Examiner* — Khiem M Nguyen
(74) *Attorney, Agent, or Firm* — Greenblum & Bernstein, P.L.C.

(57) ABSTRACT

Provided is a connector including at least one plate-like housing body, a plurality of groove-like terminal housing chambers each opened in an upper surface of the housing body and parallelly arranged, a plurality of connection terminals provided at ends of a plurality of electrical wirings and housed and disposed in the terminal housing chambers,
(Continued)

respectively, and a cover part overlapping with the upper surface of the housing body to cover the terminal housing chambers, wherein an elastic locking claw, which allows each of the connection terminals to be inserted into each of the terminal housing chambers by elastic deformation and is locked to each of the connection terminals to prevent each of the connection terminals from coming out of each of the terminal housing chambers by elastic restoring, is provided to protrude from a bottom surface of each of the terminal housing chambers.

5 Claims, 8 Drawing Sheets

(51) Int. Cl.
*H01R 13/502* (2006.01)
*H01R 13/518* (2006.01)

(58) Field of Classification Search
USPC ..... 439/733.1, 752
See application file for complete search history.

(56) References Cited

U.S. PATENT DOCUMENTS

| | | | |
|---|---|---|---|
| 2002/0026710 | A1 | 3/2002 | Murakami et al. |
| 2010/0255734 | A1 | 10/2010 | Nakata et al. |
| 2018/0183171 | A1 | 6/2018 | Washio et al. |

FOREIGN PATENT DOCUMENTS

| | | |
|---|---|---|
| JP | 2001-230038 | 8/2001 |
| JP | 2011-134571 | 7/2011 |
| JP | 2011-134580 | 7/2011 |
| JP | 2015-207511 | 11/2015 |
| JP | 2017-10759 | 1/2017 |
| WO | 2009/148027 | 12/2009 |

OTHER PUBLICATIONS

International Preliminary Report on Patentability issued in International Patent Application No. PCT/JP2018/040495 dated Sep. 30, 2019, along with English translation thereof.
U.S. Appl. No. 16/960,429 to Ebata et al., filed Jul. 7, 2020.

* cited by examiner

CONNECTOR

TECHNICAL FIELD

The present invention relates to a connector used for a wire harness routed in an automobile, for example.

BACKGROUND ART

Conventionally, a connector attached to a terminal of a wire harness includes a plurality of connection terminals each provided at each of a plurality of wiring ends constituting the wire harness and a connector housing including a plurality of terminal housing chambers each housing and holding each of the plurality of connection terminals. The terminal housing chamber of the connector housing has a tubular shape whose four sides are surrounded by a peripheral wall part, thus needed is an operation of inserting the plurality of connection terminals provided at the wiring end into the terminal housing chamber one by one in manufacturing the connector, and such an operation causes a deterioration in operability.

In contrast, as disclosed in Japanese Patent Application Laid-Open No. 2001-230038 (Patent Document 1), for example, proposed is a structure that a plate-like housing in which a plurality of groove-like terminal housing chambers are arranged side by side is adopted, and performed is an operation of inserting a plurality of connection terminals from above into the plurality of groove-like terminal housing chambers opened in an upper surface of the housing to increase the operability.

PRIOR ART DOCUMENTS

Patent Documents

Patent Document 1: Japanese Patent Application Laid-Open No. 2001-230038

SUMMARY

Problem to be Solved by the Invention

However, when such a groove-like terminal housing chamber is adopted, there is a problem that the upper surface of the terminal housing chamber is opened, so that the connection terminal easily comes out of the terminal housing chamber in an assembly operation. Considered is an adoption of a locking mechanism as a retainer, however, it is not desirable to increase a size of a connector housing due to the adoption thereof, and some kind of measures has been required.

The present invention is done on the background of the above circumstance, and a problem to be solved is to provide a connector having a novel structure capable of preventing a connection terminal from coming out of the terminal housing chamber and stably holding the connection terminal without increase in size of a housing even when a groove-like terminal housing chamber opened upward is adopted.

Means to Solve the Problem

The present invention is a connector including: at least one plate-like housing body; a plurality of groove-like terminal housing chambers each opened in an upper surface of the housing body and parallelly arranged; a plurality of connection terminals provided at ends of a plurality of electrical wirings and housed and disposed in the terminal housing chambers, respectively; and a cover part overlapping with the upper surface of the housing body to cover the terminal housing chambers, wherein an elastic locking claw, which allows each of the connection terminals to be inserted into each of the terminal housing chambers by elastic deformation and is locked to each of the connection terminals to prevent each of the connection terminals from coming out of each of the terminal housing chambers by elastic restoring, is provided to protrude from a bottom surface of each of the terminal housing chambers, a recessed portion opened in a surface disposed to face the bottom surface of each of the terminal housing chambers is provided in each of the connection terminals, a pair f locking protrusions protruding separately from each other in a longitudinal direction of each of the terminal housing chambers are provided to protrude from the bottom surface of each of the terminal housing chambers, and the pair of locking protrusions are inserted and disposed in the recessed portion of each of the connection terminals to have direct contact with a formation surface of the recessed portion of each of the connection terminals on both sides in the longitudinal direction, thus each of the connection terminals is positioned and held with respect to each of the terminal housing chambers on the both sides of the longitudinal direction.

Effects of the Invention

According to the present invention, provided is a connector capable of preventing a connection terminal from coming out of a terminal housing chamber and stably holding the connection terminal without increase in size of a housing even when a groove-like terminal housing chamber opened upward is adopted.

DESCRIPTION OF EMBODIMENT(S)

Figure 1:
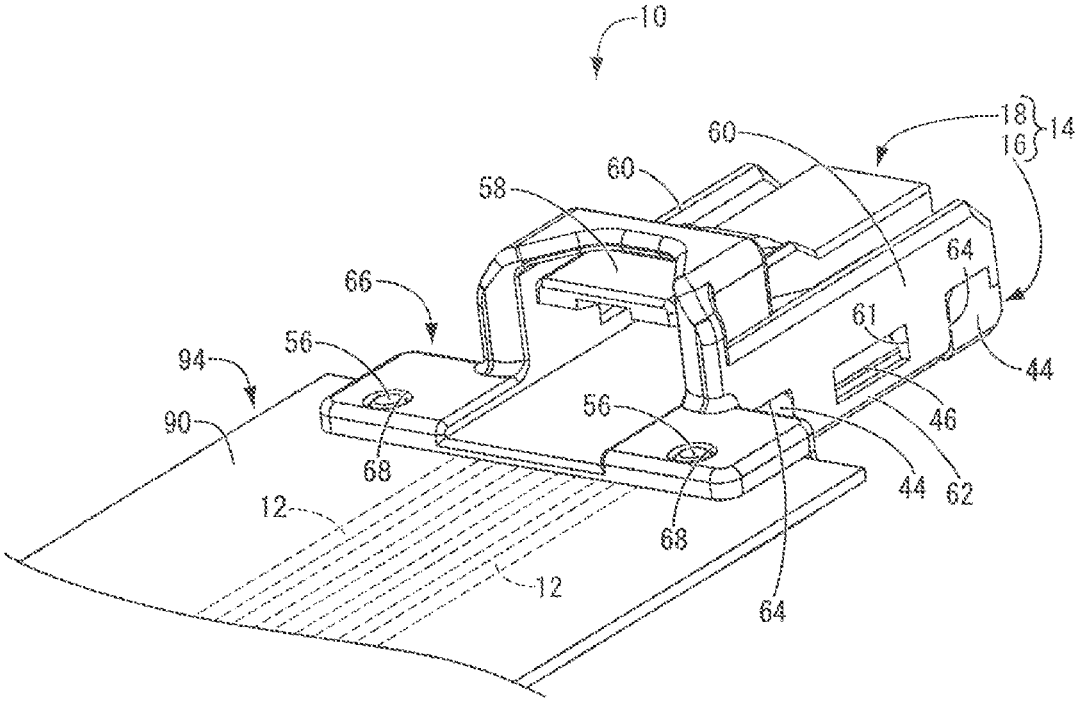
FIG. 1 An overall perspective view illustrating a connector as a first embodiment of the present invention.

Embodiments of the present invention are listed and described first.

A first embodiment of the present invention is a connector including at least one plate-like housing body, a plurality of groove-like terminal housing chambers each opened in an upper surface of the housing body and parallelly arranged, a plurality of connection terminals provided at ends of the plurality of electrical wirings and housed and disposed in the terminal housing chambers, respectively, and a cover part overlapping with the upper surface of the housing body to cover the terminal housing chambers, wherein an elastic locking claw, which allows each of the connection terminals to be inserted into each of the terminal housing chambers by elastic deformation and is locked to each of the connection terminals to prevent each of the connection terminals from coming out of each of the terminal housing chambers by elastic restoring, is provided to protrude from a bottom surface of each of the terminal housing chambers, a recessed portion opened in a surface disposed to face the bottom surface of each of the terminal housing chambers is provided in each of the connection terminals, a pair of locking protrusions protruding separately from each other in a longitudinal direction of each of the terminal housing chambers are provided to protrude from the bottom surface of each of the terminal housing chambers, and the pair of locking protrusions are inserted and disposed in the recessed portion of each of the connection terminals to have direct contact with a formation surface of the recessed portion of each of the connection terminals on both sides in the longitudinal direction, thus each of the connection terminals is positioned and held with respect to each of the terminal housing chambers on the both sides of the longitudinal direction.

According to the present embodiment, the elastic locking claw, which allows the connection terminal to be inserted into the terminal housing chamber by elastic deformation and is locked to the connection terminal to prevent the connection terminal from coming out of the terminal housing chamber by elastic restoring, is provided to protrude from the bottom surface of the terminal housing chamber. Accordingly, stably prevented is the connection terminal, which is inserted into the terminal housing chamber, coming out of the terminal housing chamber, thus the connection terminal after the assembly can be stably held in the terminal housing chamber while the plurality of connection terminals can be collectively assembled from above in cooperation with a constitutional merit of the groove-like terminal housing chambers opened in the upper surface of the housing body and parallelly arranged, for example. As a result, a misalignment and dropping of the connection terminal at the time of the assembly operation can be prevented, and assembly operability and handleability can be increased, and furthermore, reliability of manufactures can be increased, for example. Furthermore, the elastic locking claw is provided to protrude from the bottom surface of the terminal housing chamber, thus increase in size of the housing body and increase in pitch between connection terminals can be prevented compared with a case where a locking claw is provided on a side surface of the terminal housing chamber. Accordingly, the connector stably blocking the connection terminal from coming out of the terminal housing chamber can be provided while reducing or avoiding the increase in size of the housing body and connector itself.

According to the present embodiment, the pair of locking protrusions protruding from the bottom surface of the terminal housing chamber separately from each other in the longitudinal direction are inserted into the recessed portion provided in the connection terminal to have direct contact with the formation surface of the recessed portion on the both sides in the longitudinal direction, thus the connection terminal can be positioned and held in the terminal housing chamber on the both sides of the longitudinal direction. Accordingly, the connection terminal is prevented from coming out of the terminal housing chamber upward and moreover, a movement of the connection terminal on the both sides of the terminal housing chamber in the longitudinal direction (front-back direction) is regulated thus even the groove-like terminal housing chamber opened upward can stably secure a retention capability of holding the connection terminal. Furthermore, the pair of locking protrusions are provided to protrude from the bottom surface of the terminal housing chamber, thus the retention of the pitch between the connection terminals and the prevention of the increase in size of the housing body can also be advantageously achieved.

A third embodiment of the present invention is the connector according to the first embodiment, wherein a locking claw protruding toward outside in the longitudinal direction is provided to protrude from a protruding end portion of at least one of the pair of locking protrusions, the elastic locking claw is constituted by including each of the locking protrusions and the locking claw, and an upper surface of the locking claw is formed into a tapered surface inclined downward toward the outside.

According to the present embodiment, provided is the elastic locking claw preventing the connection terminal from coming out of the terminal housing chamber upward using the locking protrusion regulating a displacement of the connection terminal in the terminal housing chamber in the front-back direction, thus the connector can be further downsized and the cost can be reduced by simplifying the configuration.

A fourth embodiment of the present invention is the connector according to first or third embodiment, wherein a tubular connection part of each of the connection terminals into which another side terminal is inserted is disposed on a tip end side of each of the terminal housing chambers in the longitudinal direction, the elastic locking claw goes into and is locked to an inner surface of the connection part of each of the connection terminals when the elastic locking claw is elastically restored, and an amount of the elastic locking claw going into the inner surface of the connection part is set within range not interfering the another side terminal.

According to the present embodiment, the elastic locking claw goes into the tubular connection part of the connection terminal to be locked to the connection terminal, thus prevented is the connection terminal coining out upward. Accordingly, a retaining mechanism can be configured by using a connection part of a known connection terminal, thus the structure of the connector can be further simplified and general versatility can be increased. Furthermore, the amount of the elastic locking claw going into the inner surface of the connection part is set within range not interfering the other side terminal, thus a connection stability of the connector can be stably maintained.

A fifth embodiment of the present invention is the connector according to any one of the first, third and fourth embodiments, wherein the plurality of housing bodies are vertically stacked in layers, a lower surface of the housing body on an upper side overlapping with the housing body on a lower side constitutes a middle cover part overlapping with the upper surface of the housing body on the lower side and covering each of the terminal housing chambers, a positioning concave part or a positioning protrusion fitted to a positioning protrusion provided to protrude from the housing body on the lower side or a positioning concave part is provided at the middle cover part, and the housing bodies vertically stacked are positioned and fixed by fitting the positioning protrusion and the positioning concave part.

According to the present embodiment, the plurality of housing bodies are vertically stacked in layers, thus a laminated connector can be easily provided. Particularly, the lower surface of the housing body constitutes the middle cover part and can cover the terminal housing chamber, thus a height of the laminated connector can be reduced compared with a conventional laminated connector.

A sixth embodiment of the present invention is the connector according to any one of the first, third to fifth embodiments, wherein the cover part and the housing body, are mutually locked and fitted by a locking mechanism provided on a side wall.

According to the present embodiment, the cover part and the housing body are mutually locked and fitted by the locking mechanism provided on the side wall, thus an overlapping state of the cover part and the housing body can be stably held, and the retaining mechanism preventing the connection terminal from coming out of the terminal housing chamber can be achieved more stably.

Embodiments of the present invention are described with reference to the drawings hereinafter. In all of the drawings, the similar reference numerals will be assigned to the similar constituent elements, and the description is appropriately omitted.

Figure 2:
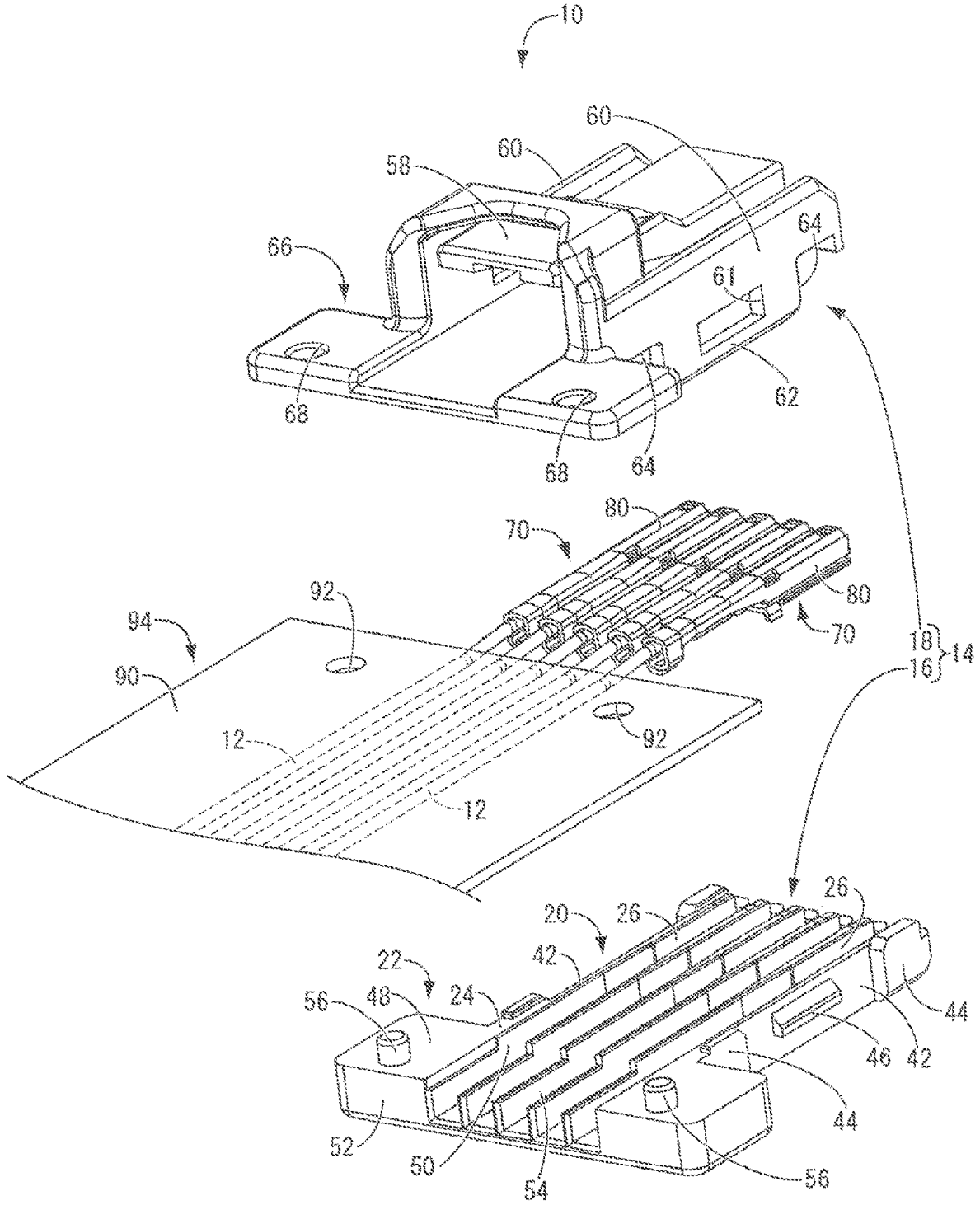
FIG. 2 An exploded perspective view of the connector illustrated in FIG. 1.
Figure 3:
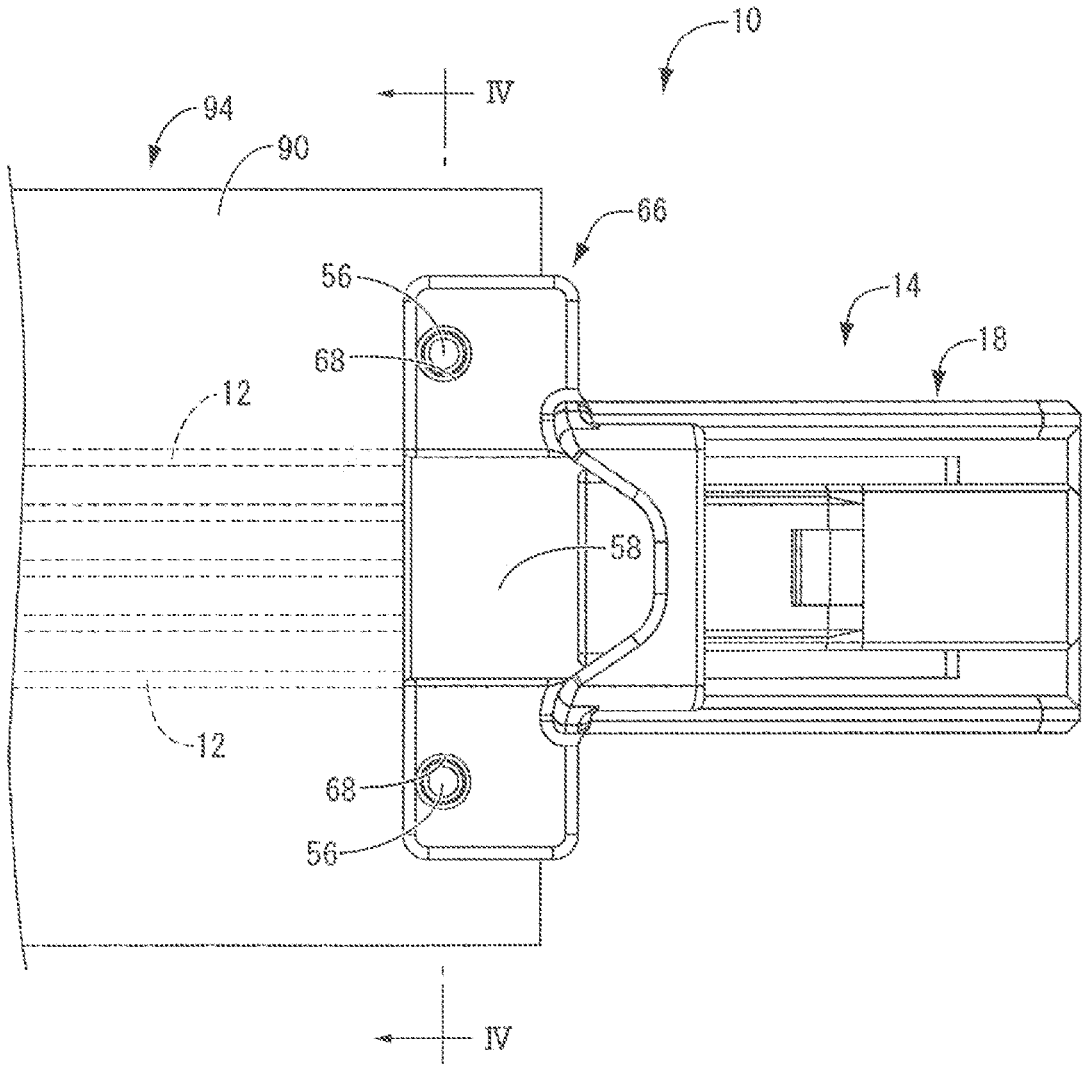
FIG. 3 A planar view of the connector illustrated in FIG. 1.
Figure 4:
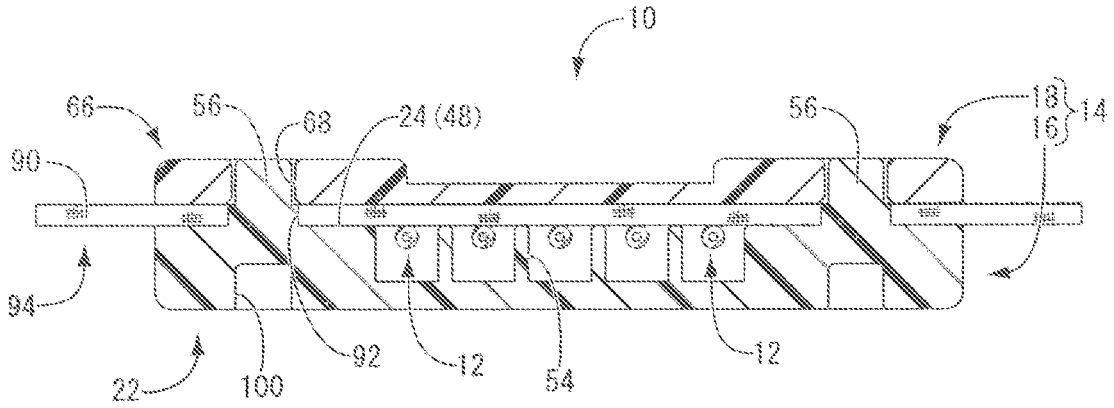
FIG. 4 An enlarged view of IV-IV cross-sectional surface in FIG. 3.

FIGS. 1 to 8 illustrate a connector 10 as a first embodiment of the present invention. As illustrated in FIGS. 1 to 3, the connector 10 includes a plurality of (five in the present embodiment) electrical wirings 12 and a connector housing 14 provided at an end of the plurality of electrical wirings 12. A front side (a right side in FIG. 3) of the connector 10 is connected to the other side connector provided for various electrical components not shown in the drawings. In the description hereinafter, an upper side indicates an upper side in FIGS. 1, 2, and 4, a lower side indicates a lower side in FIGS. 1, 2, and 4, a front side indicates a right side in FIG. 3, a back side indicates a left side in FIG. 3, a length direction indicates a right-left direction in FIG. 3, and a width direction indicates an up-down direction in FIG. 3.

Figure 5:
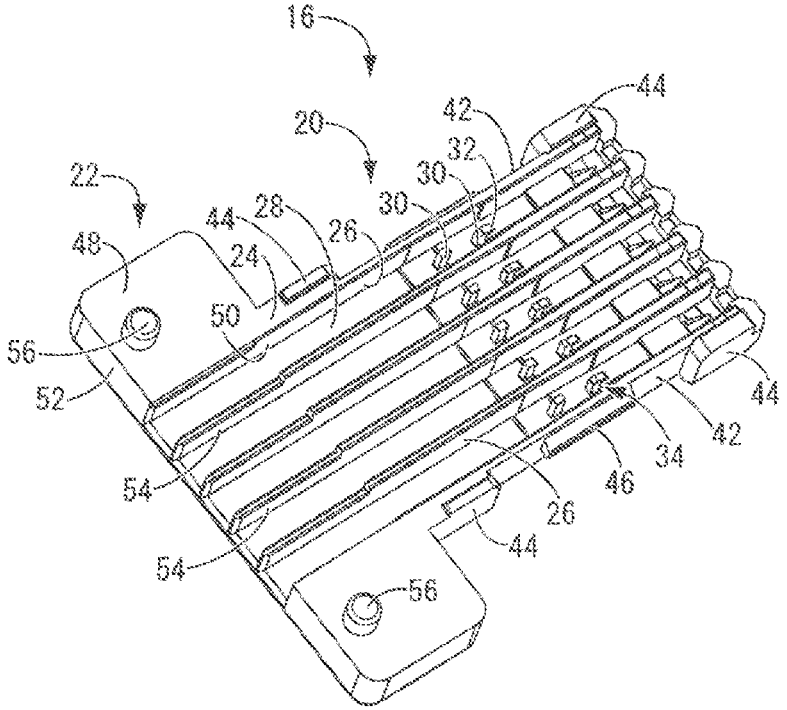
FIG. 5 A perspective view of a housing body illustrated in FIG. 2 seen from the other direction.
Figure 6:
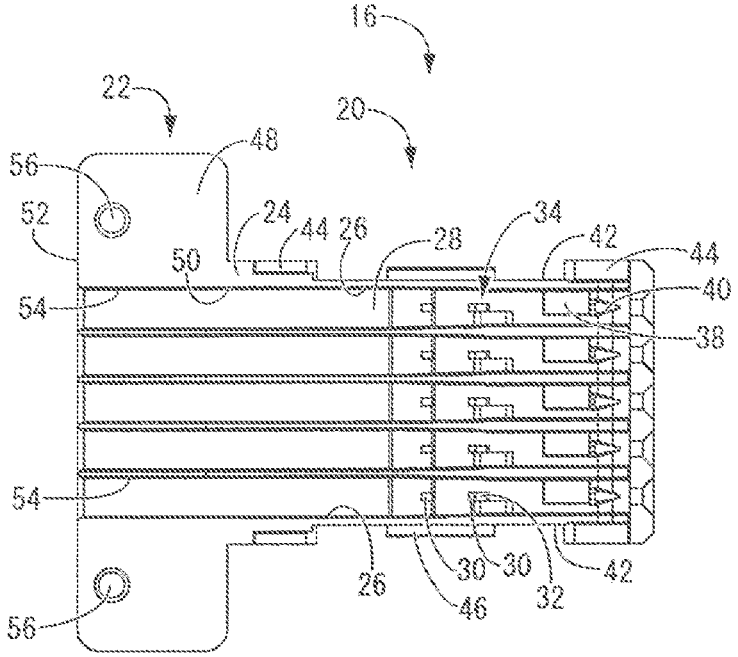
FIG. 6 A planar view of the housing body illustrated in FIG. 5.
Figure 8:
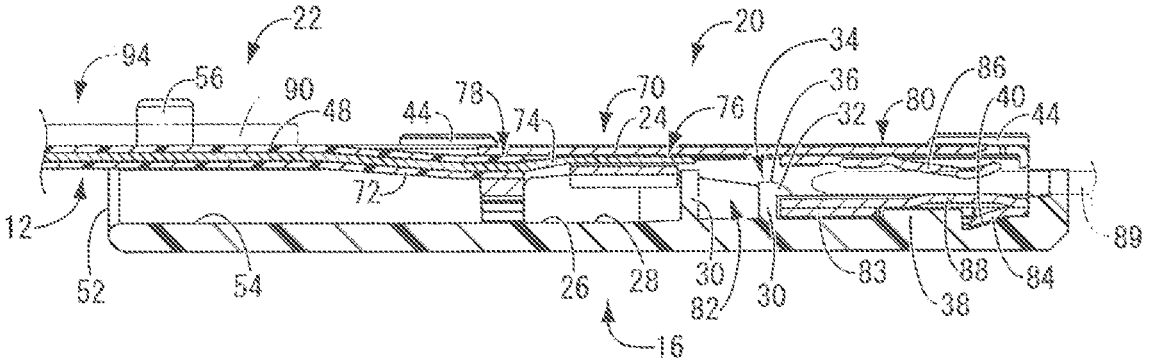
FIG. 8 An enlarged view of cross-sectional surface in FIG. 7.

As illustrated in FIG. 2, the connector housing 14 includes a housing body 16 and a cover part 18 each integrally formed of a synthetic resin such as polypropylene (PP) and polyamide (PA) by injection molding, for example. As illustrated in FIGS. 2, 5, and 6, the housing body 16 substantially has a plate-like shape. A terminal housing part 20 substantially having a horizontally-long rectangular shape in a planar view is provided at a front end side (a right end side in FIG. 6) of the housing body 16 in a length direction, and an electrical wiring support part 22 substantially having a vertically-long rectangular shape in a planar view is provided at a back end side (a left end side in FIG. 6) of the housing body 16 in the length direction. More specifically, a plurality of terminal housing chambers 26 each having a substantially groove-like shape are provided in the terminal housing part 20. Each terminal housing chamber 26 is opened outside in the length direction of the housing body 16 and in an upper surface 24 to extend toward the length direction in a substantially rectangular cross-sectional shape, and parallelly arranged with respect to a width direction (up-down direction FIG. 6). A pair of locking protrusions 30 and 30 each having a substantially rectangular column shape are provided to protrude in a central part in a width direction in a substantially central part of a bottom surface 28 of the terminal housing chamber 26 in the length direction. The pair of locking protrusions 30 protrude upward separately from each other in a longitudinal direction (right-left direction in FIG. 6) of the terminal housing chamber 26. As illustrated in FIG. 8, a locking claw 32 protruding toward outside in the longitudinal direction (right, side in FIG. 8) in a substantially triangle cross-sectional shape is provided to protrude from a protruding end portion of the locking protrusion 30 located on a front side (right side in FIG. 6) of the pair of locking protrusions 30 and 30. The locking protrusion 30 and the locking claw 32 are included to constitute an elastic locking claw 34, and an upper surface 36 of the locking claw 32 is formed into a tapered surface inclined downward toward outside (right side in FIG. 8). A protrusion height dimension of the pair of locking protrusions 30 and 30 is formed lower in the front side than in the back side, however, it only indicates, as described hereinafter, that each of them is formed to correspond to a height dimension of a core wiring crimping part 76 and an electrical wiring crimping part 78 to which the pair of locking protrusions 30 and 30 are locked, respectively, from the bottom surface 28 of the terminal housing chamber 26.

As illustrated in FIGS. 5, 6, and 8, a locking protruding part 38 protruding to have a substantially rectangular shape in a planar view is formed on a back side in a width direction (up-down direction in FIG. 6) in a front side (right side in FIGS. 6 and 8) of the elastic locking claw 34 in the bottom surface 28 of the terminal housing chamber 26. Furthermore, a locking concave part 40 opened in the bottom surface 28 of the terminal housing chamber 26 is formed on a front side of the locking protruding part 38 (right side in FIGS. 6 and 8) (refer to FIGS. 6 and 8). In addition, as illustrated in FIGS. 2, 5, and 6, fitting protrusions 44 protruding toward outside to have a substantially rectangular cross-sectional shape and extending upward are provided at a front end portion and a back end portion of both side walls 42 and 42 in a width direction (up-down direction in FIG. 6) of the terminal housing part 20. A locking part 46 protruding toward outside and extending in a length direction to have a substantially trapezoidal cross-sectional shape is formed between the fitting protrusions 44 and 44 provided on each side wall 42.

In the meanwhile, as illustrated in FIGS. 2, 5, and 6, a plurality of substantially groove-like electrical wiring housing grooves 54 are opened in an upper surface 48 of the electrical wiring support part 22 and parallelly arranged in the upper surface 48 of the electrical wiring support part 22 in a width direction (up-down direction in FIG. 6). Each of the electrical wiring housing grooves 54 is connected to a back end side opening part 50 of the terminal housing chamber 26 and opened in a back end 52 of the housing body 16 to extend toward the length direction in a substantially rectangular cross-sectional shape. Furthermore, positioning protrusions 56 are provided to protrude from both end portions in a width direction on a back end side of the upper surface 48 of the electrical wiring support part 22 to have a substantially columnar shape. A protrusion tip portion of the positioning protrusion 56 is slightly tapered. In addition, a second positioning concave part 100 described hereinafter is provided at a position corresponding to the positioning protrusion 56 in a bottom surface of the electrical wiring support part 22.

As illustrated in FIGS. 1 and 2, the cover part 18 has a substantially block-like shape, and a locking release part 58 for releasing the locking between the connector 10 and the other side connector not shown in the drawings is provided at an upper part of the cover part 18. Locking frame bodies 62 having a substantially frame-like shape are provided on both side walls 60 and 60 on the front end side of the cover part 18. The locking frame body 62 extends toward a lower side in a substantially central part in a length direction, and a through hole 61 having a substantially rectangular cross-sectional shape passes through a central part of the locking frame body 62. In the meanwhile, fitting concave parts 64 opened in a lower side and both sides in a width direction are provided on both end portions of the side wall 60 in the length direction. Furthermore, provided at a back end side of the cover part 18 is a sandwiching part 66 protruding toward a back side (left side in FIG. 3) to have a substantially rectangular plate-like shape and extending toward both sides in a width direction (up-down direction in FIG. 3). A through hole 68 is formed in the both sides in the width direction on the back end side of the sandwiching part 66 to pass therethrough in a substantially circular cross-sectional shape in the up-down direction.

Figure 7:
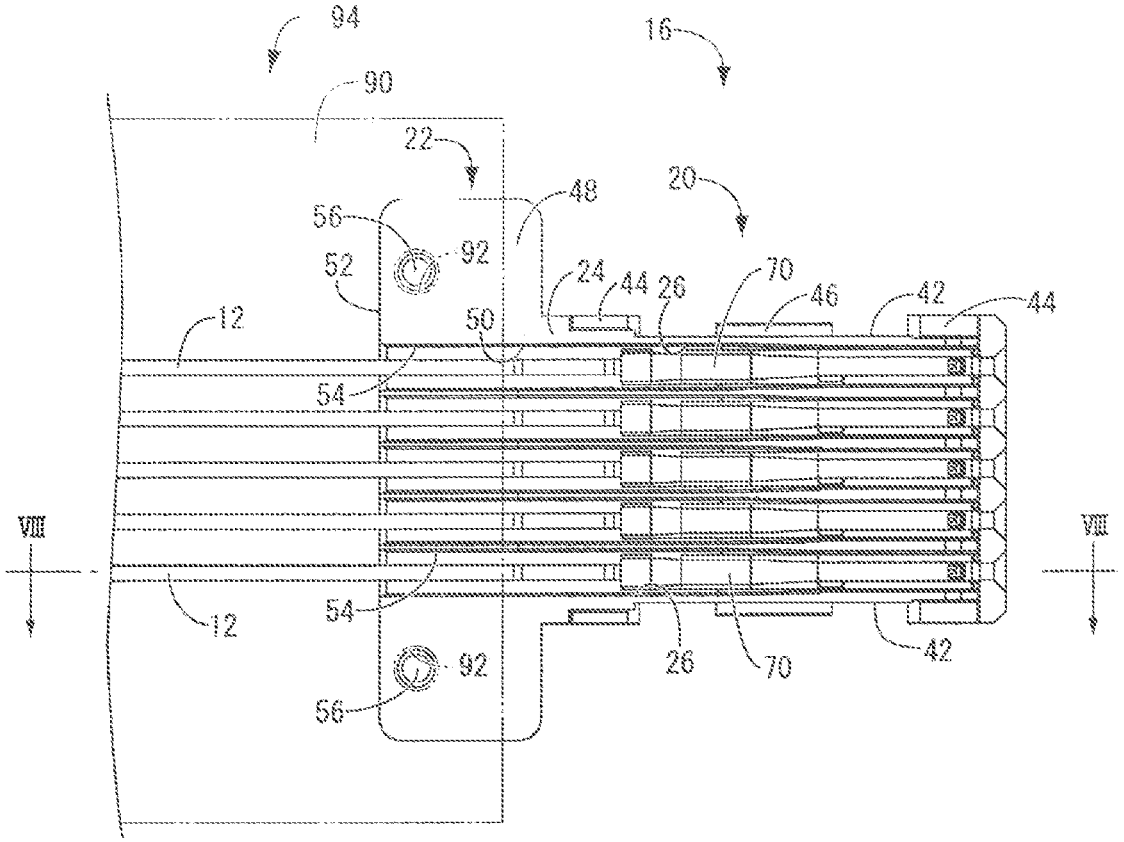
FIG. 7 A planar view illustrating a configuration that an electrical wiring including a connection terminal and a sheet-like reinforced member is housed and disposed in the housing body illustrated in FIG. 5.

As illustrated in FIGS. 2, 7, and 8, each connection terminal 70 is connected to each end of the electrical wiring 12. More specifically, an insulating coating 72 on a tip end side (right side in FIG. 8) of the electrical wiring 12 is peeled to expose a core wiring 74. Then, crimping work is performed for the core wiring 74 to the core wiring crimping part 76 of the connection terminal 70 and a tip portion of the electrical wiring 12 to which the core wiring 74 is exposed to the electrical wiring crimping part 78 of the connection terminal 70, thus the electrical wiring 12 is fixed and connected to the connection terminal 70. Furthermore, a tubular connection part 80 opened in a length direction (right-left direction in FIG. 8) is formed in a tip portion (right side in FIG. 8) of the connection terminal 70. As illustrated in FIG. 8, a recessed portion 82 is opened in a surface of the connection terminal 70 disposed to face the bottom surface 28 of the terminal housing chamber 26 between the core wiring crimping part 76 and the connection part 80. In addition, formed on an outer surface of the connection part 80 are a locking part 83 extending along an outer surface in a back end portion (left end portion in FIG. 8) on a lower part and a locking part 84 extending diagonally backward toward outside in a front end portion (right end portion in FIG. 8) on a lower part in FIG. 8. Formed in an inner surface of the connection part 80 is an elastic contact piece 86 extending along the inner surface from the back end portion (left end portion in FIG. 8) in the upper part and extending diagonally forward toward inside. The front end side (right end side in FIG. 8) on the lower part in FIG. 8 in the inner surface of the connection part 80 protrudes inward, thus an emboss part 88 is formed thereon. The elastic contact piece 86 and the emboss part 88 sandwich the other side terminal 89, thereby being connected to the other side connector. FIG. 8 illustrates the other side terminal 89 by an imaginary line to facilitate understanding. Furthermore, as illustrated in FIG. 2, the plurality of electrical wirings 12 extending from the connection terminal 70 are fixed to a sheet-like reinforced member 90 in a state of parallelly arranged. Positioning holes 92 each having a substantially circular cross-sectional shape are provided to pass through both sides in a width direction on a front end side (right end side in FIG. 7) of the sheet-like reinforced member 90 sandwiching the plurality of electrical wirings 12.

The electrical wiring 12 has a configuration that the core wiring 74 made up of a bundle of metal wirings of copper, aluminum, or the other conductive material, for example, is covered by the insulating coating 72 such as ethylene based resin or styrene based resin having an electrical insulation property, in the meanwhile, the connection terminal 70 is integrally formed using various metal materials with electrical conductivity on which a press working or a die-cut can be performed such as brass, copper, copper alloy, aluminum, aluminum alloy, for example. A glass fiber non-woven cloth or an aramid fiber non-woven cloth impregnated with epoxy resin or phenol resin, for example, is used as the sheet-like reinforced member 90, and the sheet-like reinforced member 90 is pressed to the electrical wiring 12 by heat press, for example, thereby being able to be fixed thereto.

The connector 10 having such a configuration is assembled in a manner described hereinafter. Firstly prepared is a sheet-like reinforced member-attached electrical wiring bundle 94 in which the plurality of electrical wirings 12 each having the end to which the connection terminal 70 is connected are parallelly arranged are fixed to the sheet-like reinforced member 90. Then, each of the plurality of connection terminals 70 provided at the end of each of the plurality of electrical wirings 12 in the sheet-like reinforced member-attached electrical wiring bundle 94 is housed and disposed in each of the terminal housing chambers 26 provided in the housing body 16, and the positioning protrusion 56 in the housing body 16 is fitted into the positioning hole 92 provided to pass through the sheet-like reinforced member 90. As a result, the plurality of electrical wirings 12 extending from the back end side opening part 50 of the terminal housing chamber 26 are housed and held in the electrical wiring housing groove 54 provided in the electrical wiring support part 22, and a front end portion side (right end side in FIG. 7) of the sheet-like reinforced member 90 is placed on the upper surface 24 of the housing body 16. More specifically, the connection terminal 70 is inserted into the terminal housing chamber 26 from above so that the pair of locking protrusions 30 and 30 are disposed in the recessed portion 82. Accordingly, the elastic locking claw 34 made up of the locking protrusion 30 with the locking claw 32 located on the front side (right side in FIG. 8) is elastically deformed to a back side, thereby allowing the connection terminal 70 to be inserted into the terminal housing chamber 26. Subsequently, when the connection terminal 70 is placed on the terminal housing chamber 26, the elastic locking claw 34 is elastically restored and the locking claw 32 of the elastic locking claw 34 goes into and is locked to the inner surface of the connection part 80 of the connection terminals 70, thereby advantageously preventing the connection terminal 70 from coming out of the terminal housing chamber 26 upward (refer to FIG. 8). As a result, the pair of locking protrusions 30 and 30 are inserted and disposed in the recessed portion 82 of the connection terminal 70, and the pair of locking protrusions 30 and 30 have direct contact with the front end portion of the core wiring crimping part 76 and the back end portion of the connection part 80, which constitute a formation surface of the recessed portion 82, respectively, on the both sides of the longitudinal direction (right-left direction in FIG. 8), thus the connection terminal 70 is positioned and held with respect to the terminal housing chamber 26 on the both sides of the longitudinal direction. In addition, the tubular connection part 80 of the connection terminal 70 into which the other side terminal 89 is inserted is disposed on the tip end side (right side in FIG. 8) of the terminal housing chamber 26 in the longitudinal direction. As described above, the elastic locking claw 34 is elastically restored and the locking claw 32 of the elastic locking claw 34 goes into and is locked to the inner surface of the connection part 80 of the connection terminal 70, thus an amount of the elastic locking claw 34 going into the inner surface of the connection part 80 is set within range not interfering the other side terminal 89.

Finally, the cover part 18 overlaps with the upper surface 24 of the housing body 16 from above, and the positioning protrusion 56 provided at the housing body 16 is pressed into the through hole 68 of the cover part 18. As a result, the cover part 18 covers the terminal housing chamber 26 of the housing body 16, and the front end portion of the sheet-like reinforced member 90 of the sheet-like reinforced member-attached electrical wiring bundle 94 is sandwiched between the electrical wiring support part 22 of the housing body 16 and the sandwiching part 66 of the cover part 18. Herein, a first positioning concave part into which the positioning protrusion 56 of the housing body 16 is fitted is formed to be opened in the lower surface of the cover part 18 by the through hole 68 of the cover part 18. Furthermore, the locking part 46 constituting the locking mechanism provided on the side wall 42 of the housing body 16 is locked to the through hole 61 of the locking frame body 62 constituting the locking mechanism provided on the side wall 60 of the cover part 18. That is to say, the cover part 18 and the housing body 16 are mutually locked and fitted by the locking mechanisms 62 and 46 provided on their side walls 60 and 42. In addition, the fitting protrusion 44 provided on the side wall 42 of the housing body 16 is fitted to the fitting concave part 64 of the fitting frame body 62 provided on the side wall 60 of the cover part 18. As described above, an overlapping state of the cover part 18 and the housing body 16 can be stably held, and the sheet-like reinforced member 90 can be sandwiched between the electrical wiring support part 22 of the housing body 16 and the sandwiching part 66 of the cover part 18 more stably.

According to the connector 10 having such a configuration, once the connection terminal 70 connected to the end of each of the plurality of electrical wirings 12 is inserted and disposed in the terminal housing chamber 26 of the housing body 16 from above, the elastic locking claw 34 provided to protrude from the bottom surface 28 of the terminal housing chamber 26 is elastically deformed, thereby allowing the connection terminal 70 to be inserted into the terminal housing chamber 26, and the elastic locking claw 34 is elastically restored, thus is locked to the connection part 80 of the connection terminals 70, thereby preventing the connection terminal 70 from coming out of the terminal housing chamber 26. Accordingly, the connection terminals 70 provided at the ends of the plurality of electrical wirings 12 of the sheet-like reinforced member-attached electrical wiring bundle 94 can be collectively fitted to the plurality of terminal housing chambers 26 from above, and can be held stably. Thus, a misalignment and dropping of the connection terminal 70 at the time of an assembly operation can be prevented, and assembly operability and handleability can be increased, and furthermore, reliability of the connector 10 can be increased, for example.

The elastic locking claw 34 is formed on the bottom surface 78 of the terminal housing chamber 26 and is not provided on the side surface of the terminal housing chamber 26, thus increase in size of the housing body 16 due to increase in width of the terminal housing chamber 26 is prevented. Moreover, the retaining mechanism is configured by using the connection part 80 of the known connection terminal 70, thus the connector 10 can be further simplified and general versatility can be increased. In addition, the amount of the elastic locking claw 34 going into the inner surface of the connection part 80 is set within range not interfering the other side terminal 89, thus a connection stability of the connector 10 can be stably maintained.

Furthermore, the pair of locking protrusions 30 and 30 are inserted and disposed in the recessed portion 82 of the connection terminals 70 to have direct contact with the front end portion of the core wiring crimping part 76 and the back end portion of the connection part 80, thus the connection terminals 70 are positioned and held with respect to the terminal housing chambers 26 on the both sides of the longitudinal direction. Accordingly, the connection terminal 70 is prevented from coming out of the terminal housing chamber 26 upward as described above and moreover, a movement of the connection terminal 70 on the both sides of the terminal housing chamber 26 in the longitudinal direction is regulated, thus even the groove-like terminal housing chamber 26 opened upward can stably hold the connection terminal 70.

Figure 9:
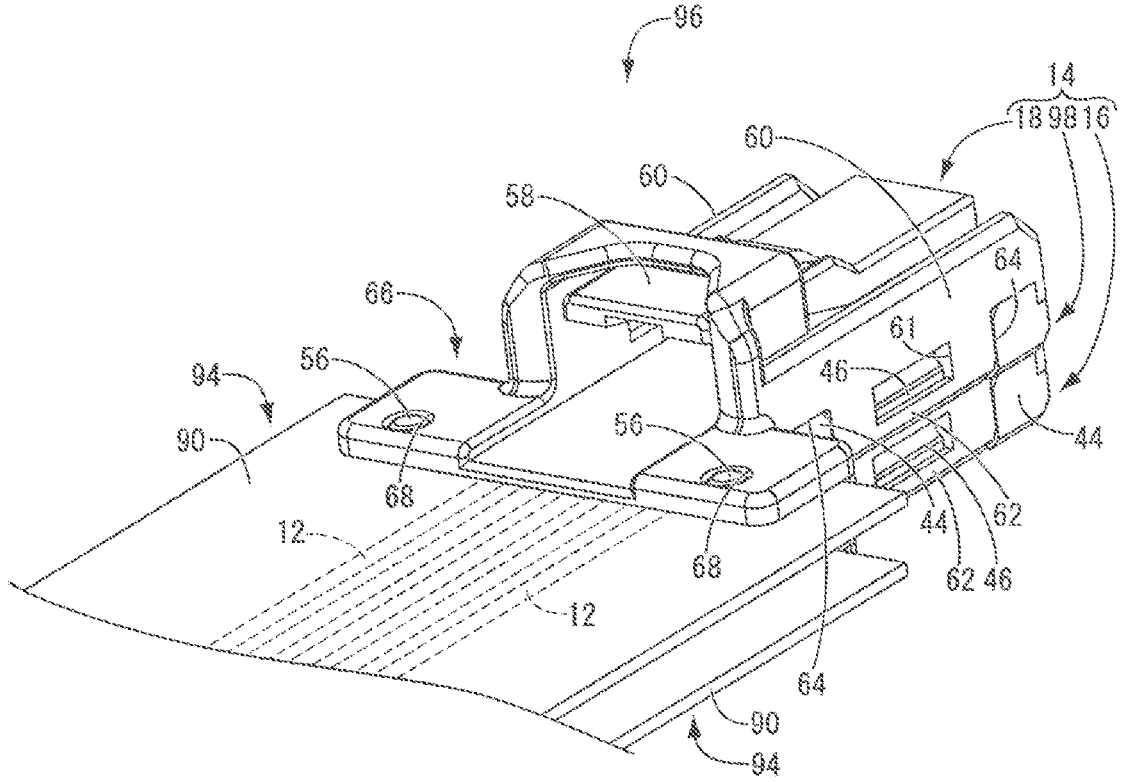
FIG. 9 An overall perspective view illustrating a connector as a second embodiment of the present invention.
Figure 10:
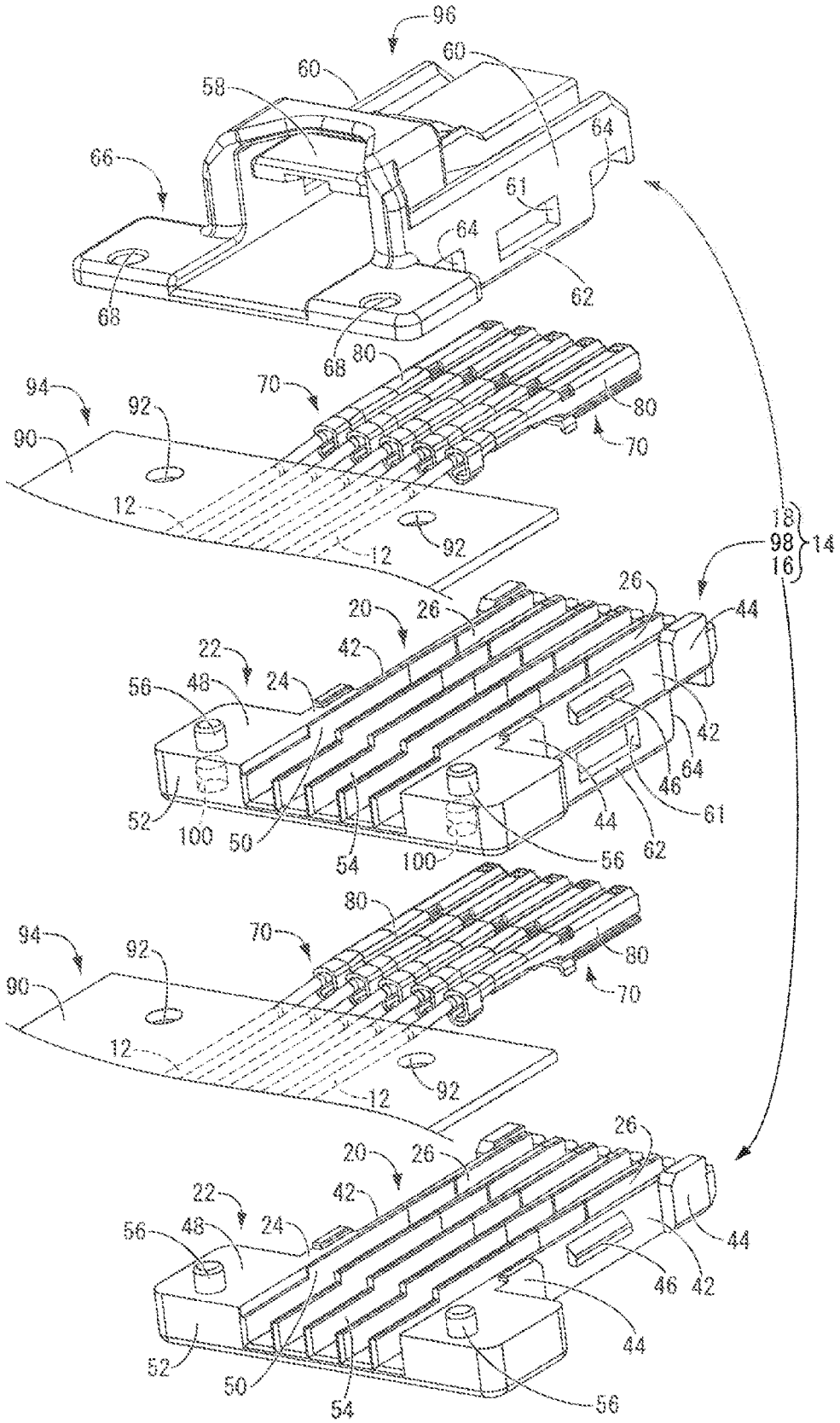
FIG. 10 An exploded perspective view of the connector illustrated in FIG. 9.

Details of the embodiments of the present invention are described above, however, the present invention is not limited to these specific descriptions. For example, in the above first embodiment, the housing body 16 is formed of a single layer, however, the housing bodies 98 and 16 may be vertically stacked in layers as is the case in the connector 96 as the second embodiment of the present invention illustrated in FIGS. 9 and 10. More specifically, as illustrated in FIGS. 9 and 10, the housing bodies 98 and 16 are vertically stacked in two layers, and the lower surface of the housing body 98 on the upper side overlapping with the housing body 16 on the lower side overlaps with the upper surface 24 of the housing body 16 on the lower side and covers the terminal housing chamber 26 of the housing body 16. Furthermore, the housing body 98 constitutes a middle cover part sandwiching the sheet-like reinforced member 90 between the middle cover part and the electrical wiring support part 22 of the housing body 16, and a second positioning concave part 100 into which the positioning protrusion 56 provided to protrude from the electrical wiring support part 22 of the housing body 16 on the lower side is fitted is provided in the middle cover part (refer to FIG. 10). The positioning protrusion 56 is pressed into the second positioning concave part 100, thus the housing bodies 98 and 16 vertically stacked in layers are positioned and fixed.

A shape of the housing body 98 disposed between the cover part 18 and the housing body 16 in a lowermost layer is the same as the housing body 16 in the lowermost layer except that the housing body 98 includes the locking frame body 62 constituting the locking mechanism. Thus, the housing bodies 16 and 98 can be manufactured with a reduced cost for mold. When the locking mechanism is not provided, only the housing body 16 can be used, thus the configuration and a parts management can be further simplified. Furthermore in the second embodiment of the present invention illustrated in FIGS. 9 and 10, the housing bodies 98 and 16 are vertically stacked in two layers, however, the number of layers to be stacked can be easily increased by increasing the number of housing bodies 98 to be stacked.

In the embodiment described above, the positioning protrusion 56 is fitted to the through hole 68 constituting the first positioning concave part and the second positioning concave part 100 by pressing, but may be fitted by insertion. In such a case, the configuration of sandwiching the sheet-like reinforced member 90 may be made up of a locking mechanism such as the locking mechanisms 46 and 62, for example. Furthermore, the first positioning concave part may be the through hole 68 as the first embodiment described above or a recessed portion such as the second positioning concave part 100. In addition, a combination of the convex part and the concave part in the positioning protrusion 56, the through hole 68 constituting the first positioning concave part, and the second positioning concave part 100 may be a combination of the concave part and the convex part. That is to say, it is also applicable that the positioning protrusion 56 is provided on a side of the housing body 98 which is the cover part 18 and the middle cover part, and the concave part is formed in the upper surface 24 of the housing bodies 16 and 98.

In addition, the sheet-like reinforced member 90 is not limited to that exemplified above, however, any member can be optionally adopted as long as it has a sheet-like shape and can fix and hold the electrical wiring 12, such as a resin sheet material provided with an adhesion layer to fix the electrical wiring 12 or a fabric sheet material to which the electrical wiring 12 is sewn. Described above as the example of the first and second embodiments is the connector fixed to the sheet-like reinforced member 90 and reinforced in the state where the plurality of electrical wirings 12 extending from the connection terminal 70 are parallelly arranged, however, it is obvious that the present invention can also be applied to a connector which needs not include such a sheet-like reinforced member 90.

Explanation of Reference Signs

10, 96: connector, 12: electrical wiring, 16: housing body, 18: cover part, 24: upper surface, 26: terminal housing chamber, 28: bottom surface, 30: locking protrusion, 32: locking claw, 34: elastic locking claw, 36: upper surface, 46: locking part (locking mechanism), 56: positioning protrusion, 62: locking frame body (locking mechanism), 68: through hole (first positioning concave part), 70: connection terminal, 80: connection part, 82: recessed portion, 89: other side terminal, 98: housing body (middle cover part), 100: second positioning concave part

The invention claimed is:

1. A connector, comprising:

at least one plate-like housing body;

a plurality of groove-like terminal housing chambers each opened in an upper surface of the housing body and parallelly arranged;

a plurality of connection terminals provided at ends of a plurality of electrical wirings and housed and disposed in the terminal housing chambers, respectively; and a cover part overlapping with the upper surface of the housing body to cover the terminal housing chambers, wherein an elastic locking claw, which allows each of the connection terminals to be inserted into each of the terminal housing chambers by elastic deformation and is locked to each of the connection terminals to prevent each of the connection terminals from coming out of each of the terminal housing chambers by elastic restoring, is provided to protrude from a bottom surface of each of the terminal housing chambers, a recessed portion opened in a surface disposed to face the bottom surface of each of the terminal housing chambers is provided in each of the connection terminals, a pair of locking protrusions protruding separately from each other in a longitudinal direction of each of the terminal housing chambers are provided to protrude from the bottom surface of each of the terminal housing chambers, and the pair of locking protrusions are inserted and disposed in the recessed portion of each of the connection terminals to have direct contact with a formation surface of the recessed portion of each of the connection terminals on both sides in the longitudinal direction, thus each of the connection terminals is positioned and held with respect to each of the terminal housing chambers on the both sides of the longitudinal direction.

2. The connector according to claim 1, wherein a locking claw protruding toward outside in the longitudinal direction is provided to protrude from a protruding end portion of at least one of the pair of locking protrusions, the elastic locking claw includes each of the locking protrusions and the locking claw, and an upper surface of the locking claw is formed into a tapered surface inclined downward toward the outside.

3. The connector according to claim 1, wherein a tubular connection part of each of the connection terminals into which another side terminal is inserted is disposed on a tip end side of each of the terminal housing chambers in the longitudinal direction, the elastic locking claw goes into and is locked to an inner surface of the connection part of each of the connection terminals when the elastic locking claw is elastically restored, and an amount of the elastic locking claw going into the inner surface of the connection part is set within range not interfering the another side terminal.

4. The connector according to claim 1, wherein the plurality of housing bodies are vertically stacked in layers, a lower surface of the housing body on an upper side overlapping with the housing body on a lower side constitutes a middle cover part overlapping with the upper surface of the housing body on the lower side and covering each of the terminal housing chambers, and the middle cover part is provided with one of a positioning concave part and a positioning protrusion, the housing body on the lower side is provided with another one of the positioning concave part and the positioning protrusion and the housing bodies vertically stacked are positioned and fixed by fitting the positioning protrusion and the positioning concave part.

5. The connector according to claim 1, wherein the cover part and the housing body are mutually locked and fitted by a locking mechanism provided on a side wall.

* * * * *